United States Patent [19]

Engel et al.

[11] 4,455,595

[45] Jun. 19, 1984

[54] PACKAGED ADD-ON DEVICE FOR LEAD-TYPE BALLAST AND LUMINAIRE WHICH INCORPORATES SUCH PACKAGED ADD-ON DEVICE

[75] Inventors: Joseph C. Engel, Monroeville; Richard E. Hanson, Coraopolis, both of Pa.; Kenneth W. Simms, Tallulah, La.; Robert J. Spreadbury, Murrysville, Pa.

[73] Assignee: Westinghouse Electric Corporation, Pittsburgh, Pa.

[21] Appl. No.: 414,275

[22] Filed: Sep. 2, 1982

[51] Int. Cl.[3] ..... F21K 2/00

[52] U.S. Cl. ..... 362/265; 362/264; 362/276; 362/294; 362/368; 362/373; 362/802; 362/263

[58] Field of Search ..... 362/276, 362, 802, 263, 362/264, 294, 368, 373, 265

[56] References Cited

U.S. PATENT DOCUMENTS

| | | | |
|---|---|---|---|
| 2,849,574 | 8/1958 | Burns et al. | 362/362 |
| 3,177,397 | 4/1965 | Keeran | 362/276 |
| 3,752,408 | 8/1973 | Tixier | 362/276 |
| 4,186,431 | 1/1980 | Engel et al. | 362/223 |
| 4,319,313 | 3/1982 | Eberhardt et al. | 362/370 |
| 4,320,443 | 3/1982 | Zwillich | 362/370 |
| 4,345,306 | 8/1982 | Summey | 362/369 |

*Primary Examiner*—Stephen J. Lechert, Jr.

*Assistant Examiner*—Howard J. Locker

*Attorney, Agent, or Firm*—Spensley, Horn, Jubas & Lubitz

[57] ABSTRACT

Add-on device for lead-type ballast comprises additional inductor and series-connected controlled AC switching means which are connected in parallel circuit with the capacitor portion of the lead-type ballast such as is used to operate an HID sodium lamp. The add-on device has a sensing and control circuit which operates to sense a lamp operating parameter in order to control the actuation of the AC switching means which in turn controls in predetermined fashion the operation of the ballasted lamp. The inductor and AC switch and sensing and control means of the add-on device are all packaged within a can-shaped member which has dimensions similar to those of the conventional capacitor can for the lead-type ballast. All the elements of the add-on device are potted within the capacitor can with terminal means extending from an end portion thereof for ready connection along with an exposed potentiometer portion to enable the control to be adjusted. The usual luminaire which utilizes a lead-type ballast normally incorporates one capacitor, although most luminaires are provided with the space for an additional capacitor, even though it is not needed. The present packaged add-on device readily fits into their available but unused space so that it is readily incorporated into existing luminaire designs.

7 Claims, 8 Drawing Figures

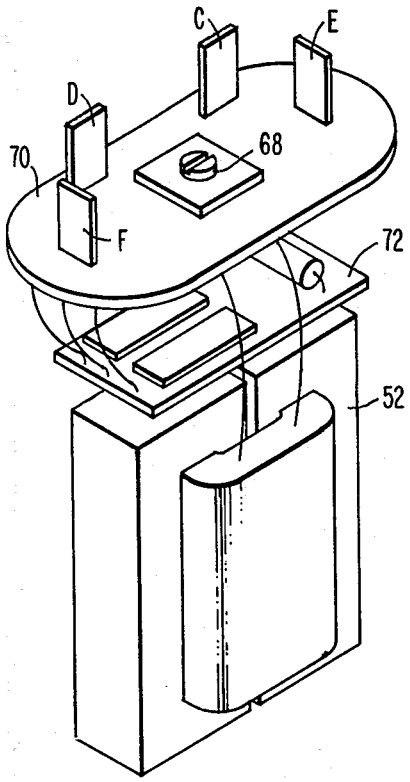
FIG.3
FIG.4
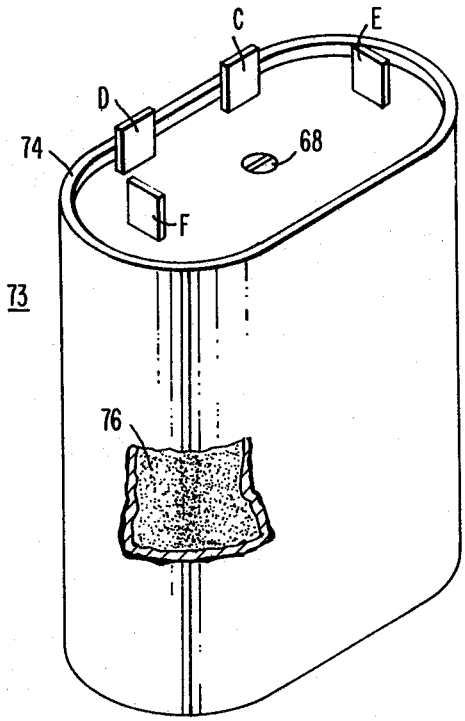
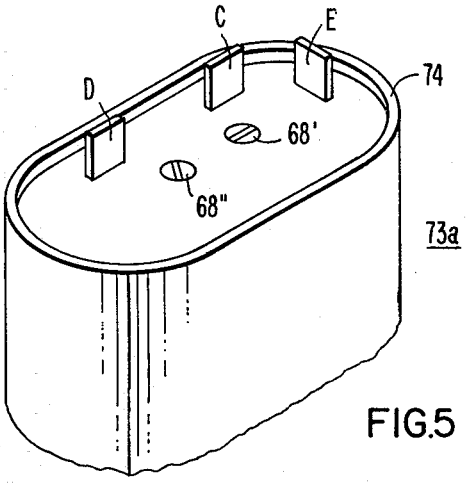
FIG.5

PACKAGED ADD-ON DEVICE FOR LEAD-TYPE BALLAST AND LUMINAIRE WHICH INCORPORATES SUCH PACKAGED ADD-ON DEVICE

CROSS-REFERENCE TO RELATED APPLICATIONS

In copending application Ser. No. 414,114, filed concurrently herewith is disclosed a ballast modifying device and a modified lead-type ballast for programming and controlling the operating performance of an HID lamp. This copending application is a continuation-in-part of application Ser. No. 282,993, filed July 14, 1981, which in turn is a continuation-in-part of application Ser. No. 264,324, filed May 18, 1981, all applications being by R. J. Spreadbury and owned by the present assignee.

In copending application Ser. No. 414,115, filed concurrently herewith by J. C. Engel and owned by the present assignee is disclosed an improved programming and control device for a modified lead-ballast for HID lamps. One embodiment of this programming and control device has been specifically tailored to operate HID sodium lamps in such a manner that the lamp wattage is carefully controlled. In another embodiment, lamp voltage variations are minimized throughout lamp life.

In copending application Ser. No. 414,276, filed concurrently herewith by Bhalla et al. is disclosed a modified method for operating an HID sodium lamp wherein lamp voltage rise, which is normally encountered through HID sodium lamp life, is minimized in order to minimize the lamp source color shifts which can be encountered with some types of HID sodium lamps.

BACKGROUND OF THE INVENTION

This invention relates to a package for an improved programming and control device for a modified lead ballast for HID lamps and particularly for HID sodium lamps and to a luminaire which incorporates such a packaged device.

The basic modifying device for a lead-type ballast is disclosed in the aforementioned copending application Ser. No. 414,114, filed concurrently herewith. In its preferred form, a series-connected additional inductor and a gate-controlled AC switch are connected in parallel across the capacitor of the lead ballast and a sensing and programming means operates to sense at least one lamp operating parameter in order to control the proportion of time the AC switch is opened and closed, which varies the current input to the lamp. An improved control device which has been specifically tailored to operate with such a basic modifiying device is disclosed in copending application Ser. No. 414,115, filed concurrently herewith by J. C. Engel.

The most common ballast which is utilized in the U.S. with HID sodium lamps is the so-called lead ballast. The basic components of such a ballast comprise a high reactance transformer with a capacitor connected in series between the transformer secondary and the lamp to be operated. The capacitor is normally contained within a can-shaped member with exposed terminals for ready connection in circuit. Most luminaires which incorporate such a lead-type ballast are fabricated so that space is provided for an additional capacitor. Recent improvements in capacitors, however, have obviated the need for a second capacitor. Because of its location within the luminaire, an additional electrical member, if used, can be readily connected in circuit if it is positioned within the available but unused space provided for the second ballast capacitor.

SUMMARY OF THE INVENTION

The present luminaire is generally conventional and comprises a housing member along with means for mounting same. A lamp socket is affixed to the housing and is adapted to receive and retain in operative position the lamp to be operated, together with means for directing in predetermined fashion the light generated by an operating lamp. Power input terminals are affixed to the housing member and are adapted to be connected to a source of electrical power and the ballast means which is retained within the housing comprises a lead-type ballast having an inductive reactance portion and a capacitive reactance portion. In conventional fashion, the inductive reactance portion comprises a current-limiting high-reactance transformer means having primary winding means connected to the luminaire power input terminals and secondary winding means terminating in secondary winding means output terminals. The capacitive reactance portion comprises a separate capacitor means which is retained in a first can-shaped member having capacitor terminals affixed thereto and the capacitor means terminal members are electrically connected in circuit between one of the transformer secondary winding means output terminals and the luminaire socket member. The luminaire is modified by an add-on device which modifies the lead-type ballast apparatus and which comprises additional inductance means and controlled AC switching means connected in series circuit, with the series-connected additional inductance means and the controlled AC switching means connected in parallel with the ballast capacitor. The AC switching means has a high impedance open position and a low impedance closed position and control terminal means. When the AC switching means is open, the modified lead-type ballast apparatus delivers a first level of current to a operating lamp and when the switching means is closed, the modified lead-type ballast delivers a lower level of current to an operating lamp. A sensing and programming means is operable to sense at least one predetermined lamp operating parameter and to generate an output signal which is indicative of a predetermined parameter desired for the operating lamp. The sensing and programming means has an output connected to the control terminal of the AC switch in order to control the relative proportion of time the AC switch is open and closed in order to control in programmed fashion the predetermined lamp operating parameter which is desired for the operating lamp.

In accordance with the present invention, the improved packaging for the add-on device comprises a second can-shaped member in which the add-on device is contained. The second can-shaped member is affixed within the luminaire housing and this second can has dimensions similar to the exterior dimensions of the capacitor portion of the ballast. Add-on device terminals are affixed to an exterior end of the second can and the additional inductance means of the add-on device occupies the major portion of the space within the second can-shaped member. There is provided a mounting board to which the sensing and control means and the AC switching means of the add-on device are affixed and the mounting board is also contained within the second can-shaped member proximate the add-on device terminals. The sensing and control means together with the AC switching means and the additional inductance means are all connected in circuit with the add-on device terminals which in turn are connected in circuit with the lead-type ballast apparatus and the lamp socket. All of the components comprising the add-on device are potted within the second can-shaped member.

BRIEF DESCRIPTION OF THE DRAWINGS

For a better understanding of the invention, reference may be had to the preferred embodiment, exemplary of the invention, shown in the accompanying drawings, in which:

FIG. 3 is an isometric view of the basic power regulating board and accompanying add-on reactor prior to incorporation in the can-shaped member;

FIG. 4 is an isometric view, partly broken away, of a power regulating add-on device as intended to be incorporated in a luminaire;

FIG. 5 is an isometric showing of a finished can-shaped member wherein only three terminals are provided such as are utilized when lamp voltage is measured to control lamp power;

DESCRIPTION OF THE PREFERRED EMBODIMENTS

Figure 1:
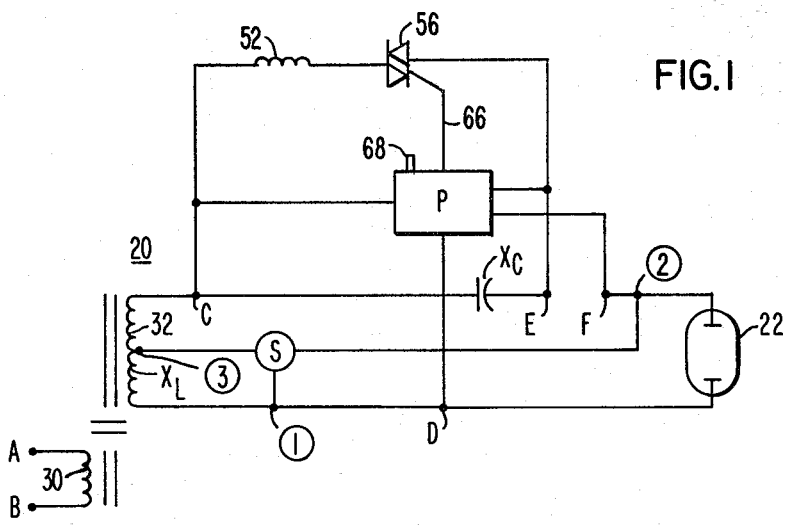
FIG. 1 is a diagram showing the general circuit arrangement for the preferred embodiment of the add-on device when it is designed to regulate lamp power, as disclosed in aforementioned copending application Ser. No. b 414,115, filed concurrently herewith.

A basic lead ballast circuit which is modified to incorporate a programming and control module is shown in FIG. 1 and this specific embodiment is described in much greater detail in aforementioned copending application Ser. No. 414,115, filed concurrently herewith. While this circuit can be used to operate any type of high-intensity-discharge lamp, including HID metal halide lamps or HID sodium lamps, it is particularly adapted to operate the sodium lamp because of the substantial voltage increases which such lamps normally exhibit throughout their life. In the embodiment as shown, the basic lead-type ballast apparatus 20 has apparatus input terminals A and B adapted to be connected across a source of AC energizing potential and apparatus output terminals F and D across which the lamp 22 to be operated is adapted to be connected. The apparatus comprises an inductive reactance portion designated $X_L$ and a capacitive reactance portion designated $X_C$. The inductive reactance portion comprises a conventional current-limiting high-reactance transformer means which has a primary winding 30 connected to the apparatus input terminals A and B and a secondary winding 32 terminating in secondary winding output terminals C and D. The capacitive reactance portion comprising the capacitor $X_C$ is connected in circuit between the secondary winding means output terminal C and the terminal E. The output terminal E connects to the apparatus output terminal F through a copper strip on a printed circuit board in order to effect current sensing. This is described in greater detail in the referenced copending application Ser. No. 414,115, filed concurrently herewith. In conventional fashion, the high reactance transformer $X_L$ can have an autotransformer construction or it can be formed with separate windings.

The basic modifying device comprises additional inductance means 52 connected in series with a gate-controlled AC semiconductor switching means 56 which has a high impedance open position and a low impedance closed position and gate terminal means 66 which connect to the basic sensing and programming means P, the preferred embodiments for which are described in detail in copending application Ser. No. 414,115, filed concurrently herewith. When the switching means 56 is open, the modified ballast apparatus delivers a first level of current to an operating lamp and when the switching means is closed, the modified ballast apparatus delivers a second and lower level of current to an operating lamp. The sensing and programming means P is operable to sense at least one predetermined lamp operating parameter and to generate an output control signal which is indicative of a predetermined parameter desired for the operating lamp. The programming means has its output connected to the gate terminal 66 of the switch 56 to control the relative proportion of time the switching means is opened and closed in order to control in programmed fashion the predetermined lamp operating parameter desired for the operating lamp.

In the circuit embodiment as shown in FIG. 1, the basic add-on device utilizes four separate terminals which connect in circuit at the points C, D, E and F. The series-connected inductance 52 and the AC switching means connect across a first pair, C and E, of the terminals and these also connect in parallel with the capacitor $X_C$. The remaining pair of the lamp terminals F and D connect across the lamp, or the lamp socket in the case of a practical embodiment. An adjustable potentiometer 68 is also provided on the programming device P in order to adapt the operation of the device to lamp-ballast combinations of different rated wattages.

In order to start an HID sodium lamp, a starter S is connected at the points (1), (2) and (3) to generate high voltage pulses, such as 2500 V, to initate initial ionization of the lamp 22. Such starter circuits are well known and a wide variety of designs are available. Typical starter circuits are described in U.S. Pat. No. 4,143,304, dated Mar. 6, 1979 and U.S. Pat. No. 4,072,878, dated Feb. 7, 1978. These starters can be classed as pulse generating means which are associated with the secondary winding of the high reactance transformer in order to generate high voltage pulses which are applied through the capacitive reactance portion of the ballast to start the lamp. Once lamp operation is initiated, the starter S is rendered inoperative. Since the programming device P is connected in parallel with the capacitive reactance $X_C$, the programming device P is protected from the high voltage starting pulses.

Figure 2:
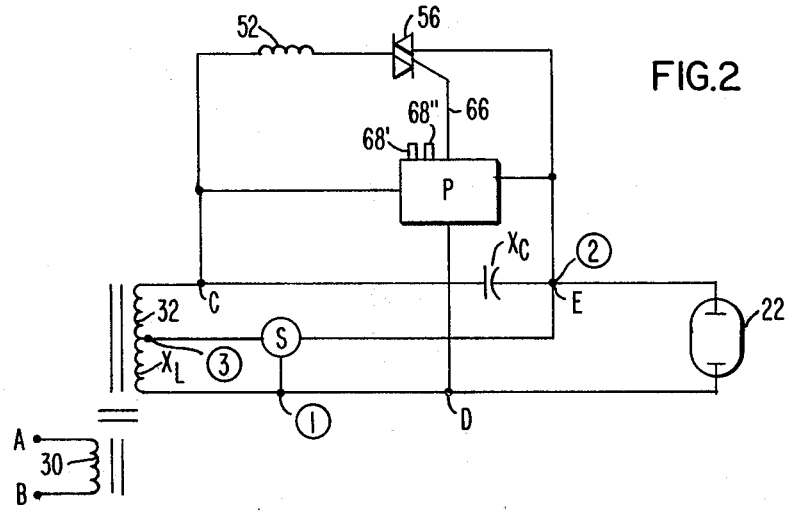
FIG. 2 is a diagram similar to FIG. 1 but showing the circuit for the add-on device which is intended to be responsive to measured lamp voltage in order to control lamp power.

In FIG. 2 is shown a basic lead ballast circuit which is modified to incorporate a controlling module which decreases lamp wattage at a predetermined rate in accordance with increasing lamp voltage, in order that lamp voltage increases which are characteristic of HID sodium lamps can be minimized throughout lamp life. This circuit arrangement is similar to that shown in FIG. 1 except that only three terminal connections C, D and E are utilized and two potentiometer adjustments 68′ and 68″ are used. One of these potentiometer adjustments 68′ is used to adjust the rate at which the lamp wattage is controlled during lamp warm-up in accordance with measured lamp voltage and the other potentiometer adjustment 68″ is used to set the measured lamp voltage value at which the programming and control device becomes functional. The basic method for operating a lamp in such a mode is described in detail in copending application Ser. No. 414,276, filed concurrently herewith, by Bhalla et al. and the preferred circuit embodiment for practicing this method is disclosed in aforementioned copending application Ser. No. 414,115, filed concurrently herewith by J. C. Engel.

In FIG. 3 are shown the basic add-on device components prior to incorporation into the can-shaped member. In this embodiment, four terminals are provided for connection at points C, D, E and F. The printed circuit board 70 has the electronic control circuitry affixed to the bottom portion thereof and in this embodiment, a clock or timer 72 is also connected in circuit and functions to dim the lamps during the late-night hours when less illumination is needed. Such a clock or timer is optional and this is described in detail in aforementioned copending application Ser. No. 414,115. The add-on inductor or reactor 52 occupies the major portion of the can-shaped container for the add-on device and as an example, the reactor 52 is designed to have an inductive reactance of 159 mH. The potentiometer 68 is also affixed to the upper surface of the printed circuit board 70.

In FIG. 4 is shown the finished add-on device 73 wherein the can-shaped member 74 has the general configuration of a ballast capacitor can so that it can be readily mounted in the luminaire. The components comprising the working portion of the add-on device as shown in FIG. 3, are inserted into the can-shaped member 74 and are then potted with conventional potting material, such as a sand-epoxy mixture 76. This leaves exposed only the four terminals C, D, E and F and the single potentiometer adjustment 68.

In FIG. 5 is shown an alternative add-on device 73*a* which is designed for sensing the lamp voltage in order to control the lamp power, as described hereinbefore, and the finished device differs in that only three terminal connections C, D and E are used and project from an end portion of the can-shaped member 74. In this embodiment, two potentiometers 68′ and 68″ are used.

Figure 6:
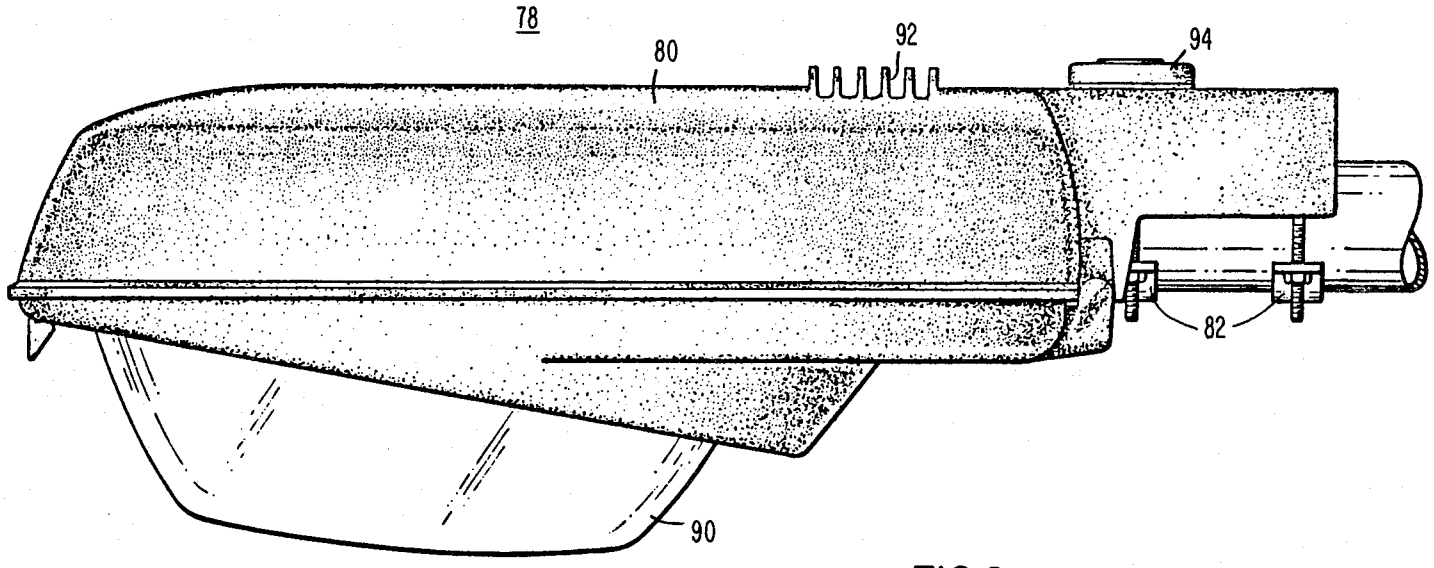
FIG. 6 is an elevational view of a finished luminaire of a type which can incorporate the present packaged add-on device.

In FIG. 6 is shown an elevational view of a conventional luminaire 78 for a HID high-pressure sodium lamp. The luminaire comprises a housing member 80 and means 82 for mounting the housing member. The luminaire encloses a lamp socket which is adapted to receive and retain in operative position the lamp to be operated, along with the associated reflector members and refractor 90 which serve to direct in predetermined fashion the light generated by an operating lamp. The housing is also provided with cooling vanes 92 and it is adapted to receive a plug-in type photocontrol at the receptacle 94. The general luminaire construction is conventional.

Figure 7:
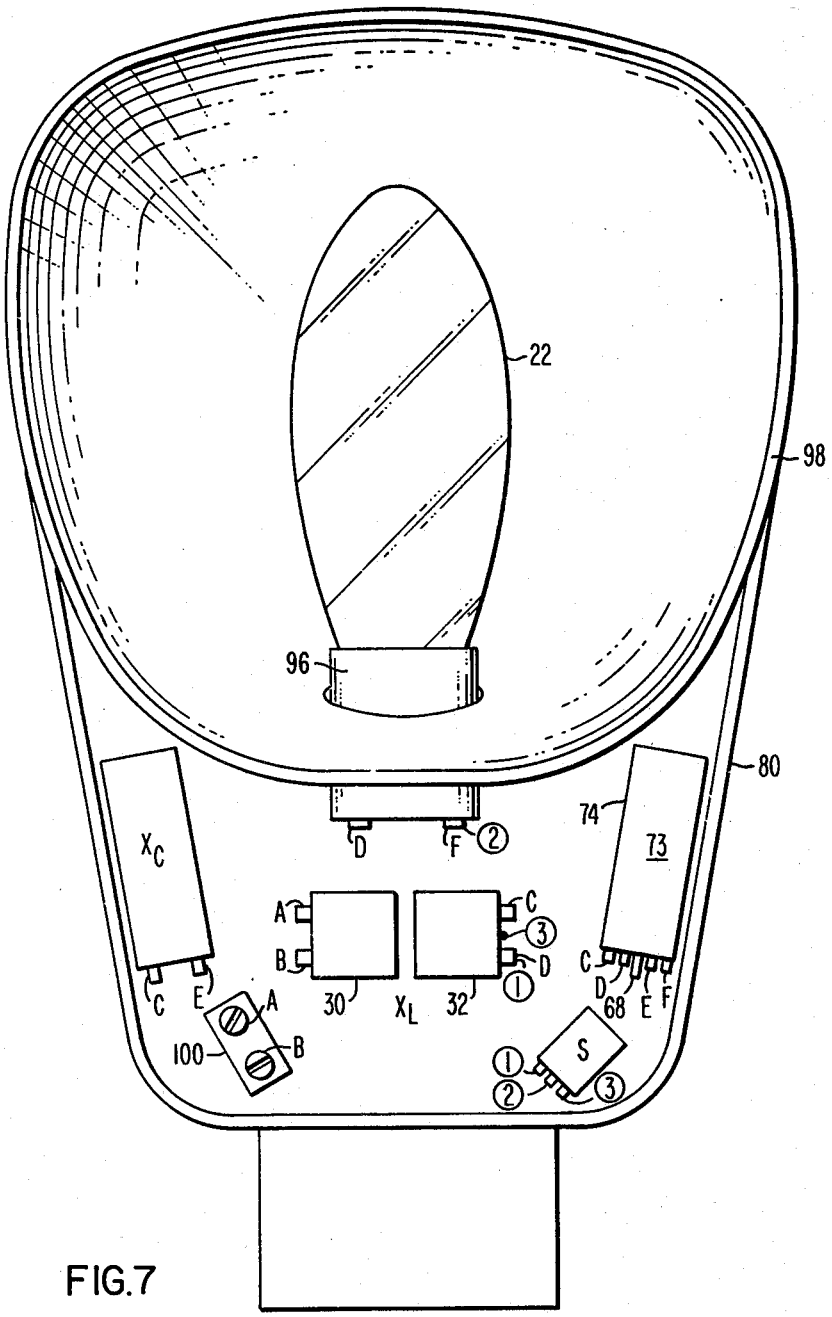
FIG. 7 is a partial bottom view of a luminaire showing one embodiment of the present add-on device as it is intended to be mounted in the luminaire housing and wired into the luminaire circuitry.

Referring to FIG. 7, there is illustrated a partial bottom view of a luminaire generally as shown in FIG. 6 and the mounting arrangement and wiring arrangement for the electrical components of the luminaire are shown in detail. Viewing FIG. 7 in conjunction with the general circuit diagram as shown in FIG. 1, the lamp socket means 96 is affixed to the housing member 80 and is adapted to receive and retain in operative position the lamp 22 to be operated. The reflector member 98 in conjunction with the refractor 90, see FIG. 6, serves to direct the generated light in predetermined fashion. A power input terminal block 100 is affixed to the housing 80 and terminals A, B are adapted to be connected to a source of electrical power. The inductive reactance portion $X_L$ of the lead-type ballast is positioned directly behind the lamp socket 96 and the connections A, B to the primary winding 30 are illustrated as are the output terminals C, D of the secondary winding 32. The capacitive reactance portion $X_C$ comprises a separate capacitor retained in a first can-shaped member having a capacitor terminal members C, E affixed thereto. The add-on device 73 is provided with four terminals C, D, E and F as well as an adjusting potentiometer 68. The wiring interconnections between the circuit elements have not been shown, but in the device as it is connected for operation, all similarly lettered terminals, e.g. A—A, B—B, etc., are directly connected and the connections (1)—(1), (2)—(2) and (3)—(3) for the starter are also similarly directly connected.

Figure 8:
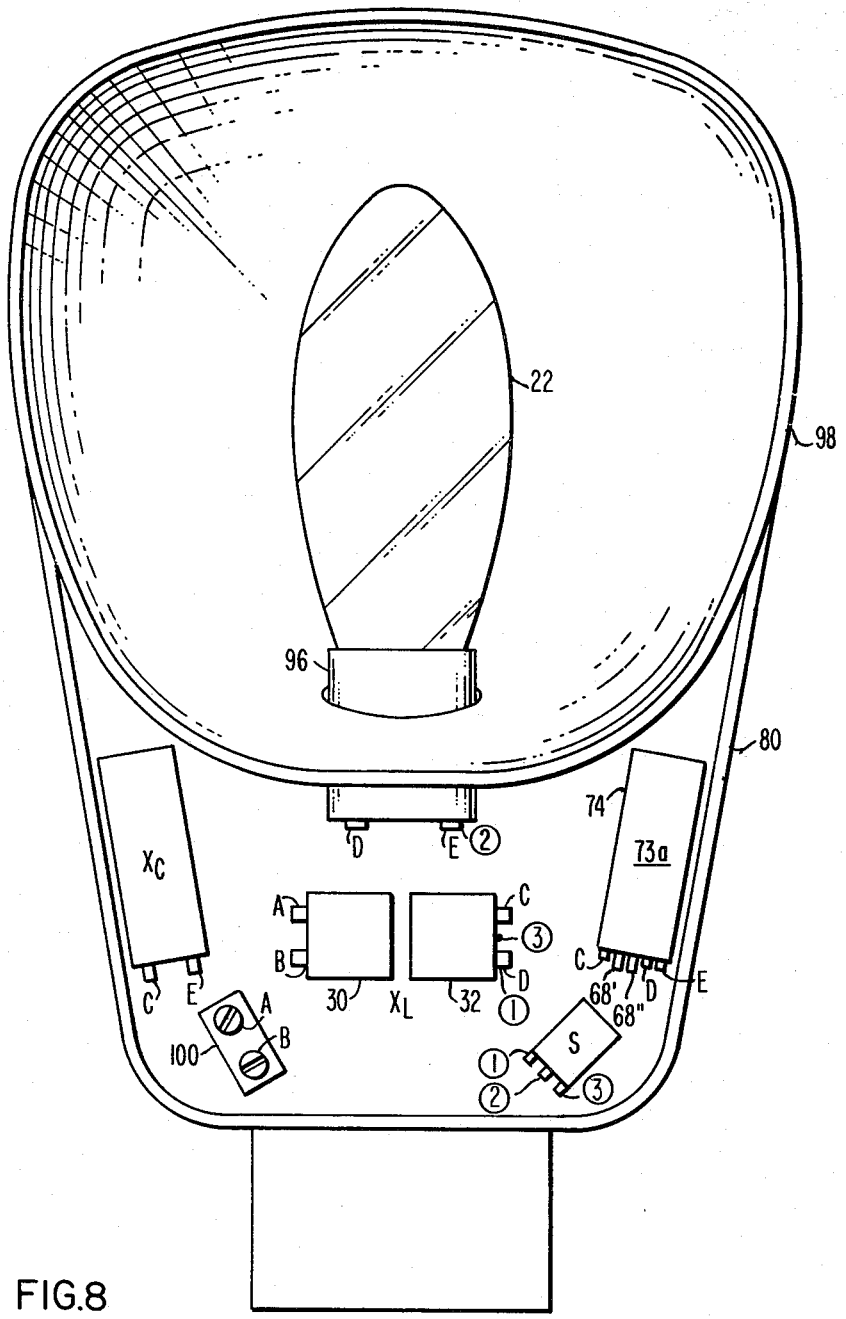
FIG. 8 is a partial bottom view of a luminaire showing another embodiment of the present add-on device as it is intended to be mounted in the luminaire housing and wired into the luminaire circuitry.

In FIG. 8 is shown the luminaire embodiment wherein the add-on device 73*a* as shown in FIG. 5 is incorporated into the luminaire. This device only has three terminal connections C, D and E on the add-on device 73*a* along with two potentiometer connections 68′ and 68″. In other respects, this embodiment is identical to the embodiment as shown and described in FIG. 7 and similarly lettered terminals are directed connected as are the starter connections which are numbered (1), (2) and (3).

Since the luminaire housing, which is normally of cast aluminum construction, is already designed to receive and contain two capacitors, and only one capacitor $X_C$ is now required, incorporation of either of the add-on devices 73 or 73*a* is a simple matter and requires only the indicated additional interconnections. In similar fashion, if desired, existing luminaires can be retrofitted to incorporate the present add-on device which is contained in the can-shaped member 74.

We claim:

1. In combination with a luminaire for a high-intensity-discharge high-pressure sodium lamp, said luminaire comprising a housing member and means for mounting said housing member, lamp socket means affixed to said housing member and adapted to receive and retain in operative position the lamp to be operated, means for directing in a predetermined fashion the light generated by an operating lamp, power input terminals affixed to said housing member and adapted to be connected to a source of electrical power, and ballast means retained within said housing member and comprising a lead-type ballast apparatus having an inductive reactance portion and a capacitance reactance portion, said inductive reactance portion comprising a current-limiting high-reactance transformer means having primary winding means coupled to said luminaire power input terminals and secondary winding means terminating in secondary winding means output terminals, and said capacitive reactance portion comprising separate capacitor means retained in a first can-shaped member having capacitor terminal members affixed thereto, and said capacitor means terminal members electrically coupled in circuit between one of said secondary winding means output terminals and said luminaire socket member, said luminaire is modified by an add-on device which modifies said lead-type ballast apparatus and which comprises: additional inductance means and controlled AC switching means coupled in series circuit, with said series-connected additional inductance means and said controlled AC switching means coupled in parallel with said capacitor means, said AC switching means having a high impedance open position and a low impedance closed position and control terminal means, which said AC switching means is open, said modified lead-type ballast apparatus delivers a first level of current to an operating lamp, and when said AC switching means is closed, said modified lead-type ballast apparatus delivers a lower level of current to an operating lamp; and sensing and programming means operable to sense at least one predetermined lamp operating parameter and to generate an output control signal which is indicative of a predetermined parameter desired for said operating lamp, and said sensing and programming means having an output coupled to the control terminal means of said AC switching means to control the relative proportion of time said AC switching means is open and closed in order to control in programmed fashion the predetermined lamp operating parameter desired for said operating lamp; improved packaging for said add-on device, which comprises:

a second can-shaped member in which said add-on device is contained, said second can-shaped member affixed within said luminaire housing member and having exterior dimensions similar to the exterior dimensions of said first can-shaped member, add-on device terminal means affixed to an exterior end portion of said second can-shaped member, said additional inductance means of said add-on device occupying the major portion of the space within said second can-shaped member, a mounting board to which said sensing and programming means and said AC switching means of said add-on device are affixed, said mounting board is also contained within said second can-shaped member proximate said add-on device terminal means, said sensing and programming means together with said AC switching means and said additional inductance means are coupled in circuit with said add-on device terminal means, said add-on device terminal means are coupled in circuit with said lead-type ballast apparatus and said lamp socket means, and the components comprising said add-on device are potted within said second can-shaped member.

2. The luminaire as specified in claim 1, wherein said additional inductance means of said add-on device connects in series with said AC switching means of said add-on device, said add-on device terminal means comprise four separate terminals, said series-connected additional inductance means and said AC switching means connect across a first pair of said four terminals of said add-on device, and said first pair of said add-on device terminals connect in parallel with said capacitor means, said sensing and programming means of said add-on device connect to said add-on device terminals, and the remaining pair of said add-on device terminals connect across said lamp socket means, potentiometer means is included as a part of said sensing and control means to adjust the programming of said sensing and control means to match that desired for said lamp to be operated, and said potentiometer means has a rotatable adjusting means which extends exteriorly of said second can-shaped member proximate said add-on device terminals.

3. The luminaire as specified in claim 1, wherein said add-on device terminals comprise three separate terminals, said series-connected additional inductance means and said AC switching means connect across a first and a second of said three add-on device terminals, said first and said second of said three add-on device terminals connect in parallel with said capacitor means, and said second and said third of said three add-on device terminals connect across said lamp socket means, potentiometer means are included as a part of said sensing and control means to adjust the programming of said sensing and control means to match that desired for said lamp to be operated, and said potentiometer means has rotatable adjusting means which extends exteriorly of said second can-shaped member proximate said add-on device terminals.

4. A packaged add-on device which is adapted to be securely affixed within the interior of a luminaire housing for a high-intensity-discharge sodium lamp, said luminaire including a lamp retaining socket means and lead-type ballast means for operating said lamp, said ballast means affixed within said housing and including as an operative part thereof a capacitor means contained within a first can-shaped member of predetermined dimensions, said packaged add-on device comprising:

a second can-shaped member in which said add-on device is contained, said second can-shaped member having exterior dimensions similar to those of said first can-shaped member; add-on device terminals affixed to an exterior end portion of said second can-shaped member; said add-on device including as essential elements inductance means and series-connected AC switching means and sensing and control means, and said add-on device inductance means occupying the major portion of the space within said second can-shaped member; a mounting board to which said sensing and control means and said AC switching means of said add-on device are affixed, said mounting board contained within said second can-shaped member proximate said terminals; said sensing and control means together with said AC switching means and said inductance means are connected in predetermined circuit arrangement with said add-on device terminals, and said add-on device terminals are adapted to be connected in predetermined circuit arrangement with said lead-type ballast means; and the components comprising said add-on device are potted within said second can-like member.

5. A packaged add-on device as specified in claim 4, wherein said add-on device terminals comprise four separate terminals, said inductance means and said AC switching means connect in series and across a first pair of said terminals, said first pair of terminals are adapted to be connected in parallel with said capacitor means, said sensing and control means connect to said add-on device terminals, and the remaining pair of said add-on device terminals connect to said lamp retaining socket means, potentiometer means is included as a part of said sensing and control means to adjust the programming of said sensing and control means to match that desired for said lamp to be operated, and said potentiometer means has a rotatable adjusting means which extends exteriorly of said can-shaped member proximate to said add-on device terminals.

6. A packaged add-on device as specified in claim 4, wherein said additional inductance means of said add-on device connects in series with said AC switching means of said add-on device, said add-on device terminals comprise three separate terminals, said series-connected additional inductance means and said AC switching means connect across a first and a second of said three terminals, said first and said second of said three terminals connect in parallel with said capacitor means, and said second and said third of said three terminals connect across said lamp socket means, potentiometer means are included as a part of said sensing and control means to adjust the programming of said sensing and control means to match that desired for said lamp to be operated, and said potentiometer means has rotatable adjusting means which extends exteriorly of said second can-shaped member proximate said add-on device terminals.

7. A packaged add-on ballast device which is adapted to be affixed within the interior of a luminaire housing for a high-intensity-discharge sodium lamp, said luminaire including a socket for retaining a lamp and lead-type ballast means for regulating the operation of the lamp, said ballast means having a ballast capacitor contained within a first can-shaped container and said luminaire having means for affixing the first can-shaped container and a second can-shaped container to the housing wherein said second can-shaped container has the general configuration of a ballast capacitor container; said packaged add-on ballast device comprising:

a second can-shaped container having the general configuration of a ballast capacitor container;

an inductor which occupies a substantial portion of the interior of the second container; and switch means contained within the second container for coupling the inductor in circuit with the capacitor of the ballast means;

wherein the packaged add-on ballast device is readily adapted to be affixed to the luminaire housing by the luminaire housing affixing means without necessitating substantial modification to the luminaire.

* * * * *